US005185901A

United States Patent [19]

Davis et al.

[11] Patent Number: 5,185,901

[45] Date of Patent: Feb. 16, 1993

[54] BOWLING LANE MAINTENANCE MACHINE CAPABLE OF SELF-INDEXING FROM LANE-TO-LANE

[75] Inventors: John M. Davis; Mark E. Davis; David G. Jennings, all of Sebring, Fla.

[73] Assignee: The Kegel Company, Inc., Sebring, Fla.

[21] Appl. No.: 713,725

[22] Filed: Jun. 11, 1991

[51] Int. Cl.[5] ..... A47L 11/14; A47L 11/282

[52] U.S. Cl. ..... 15/98; 15/50.3; 51/176; 180/202; 364/140

[58] Field of Search ..... 15/50.3, 98, 340.3, 15/340.4, 319; 180/199, 200, 202; 364/140; 51/174-177

[56] References Cited

U.S. PATENT DOCUMENTS

| | | | |
|---|---|---|---|
| 1,118,870 | 11/1914 | Lane . | |
| 2,978,721 | 4/1961 | Simmons . | |
| 3,083,390 | 4/1963 | Wroten . | |
| 3,103,087 | 9/1963 | Goff . | |
| 3,150,407 | 9/1964 | Mitchell . | |
| 3,216,036 | 11/1965 | Rockwood et al. . | |
| 3,216,037 | 11/1965 | Stevens et al. . | |
| 3,273,532 | 9/1966 | Brzuskiewicz et al. . | |
| 3,418,672 | 12/1968 | Regan . | |
| 3,837,028 | 9/1974 | Bridge . | |
| 3,868,738 | 3/1975 | Horst et al. . | |
| 4,134,361 | 1/1979 | Benjamin . | |
| 4,137,591 | 2/1979 | Baker . | |
| 4,246,674 | 1/1981 | Ingermann et al. . | |
| 4,275,884 | 6/1981 | Smith . | |
| 4,463,469 | 8/1984 | Green . | |
| 4,510,642 | 4/1985 | Ingermann et al. . | |
| 4,708,603 | 11/1987 | Kubo . | |
| 4,727,615 | 3/1988 | Kubo . | |
| 4,738,000 | 4/1988 | Kubo . | |
| 4,920,604 | 5/1990 | Ingermann et al. | 15/98 |
| 4,959,884 | 10/1990 | Ingermann et al. | 15/98 |
| 4,962,565 | 10/1990 | Ingermann et al. | 15/98 |
| 4,980,815 | 12/1990 | Davis | 15/98 |

*Primary Examiner*—Edward L. Roberts

*Attorney, Agent, or Firm*—Hovey, Williams, Timmons & Collins

[57] ABSTRACT

A bowling lane maintenance machine (10) performs selected maintenance operations on the surface of the bowling lane, shifts itself to the approach area spanning a plurality of lanes behind the foul line end of the lanes, indexes to another lane, and then shifts to the lane to again perform a maintenance operation thereon. The machine (10) includes structural housing (12) cleaning maintenance assembly (14), propulsion assembly (16), and electronic control system (18); which cooperate for controlled maintenance operations as described above.

18 Claims, 8 Drawing Sheets

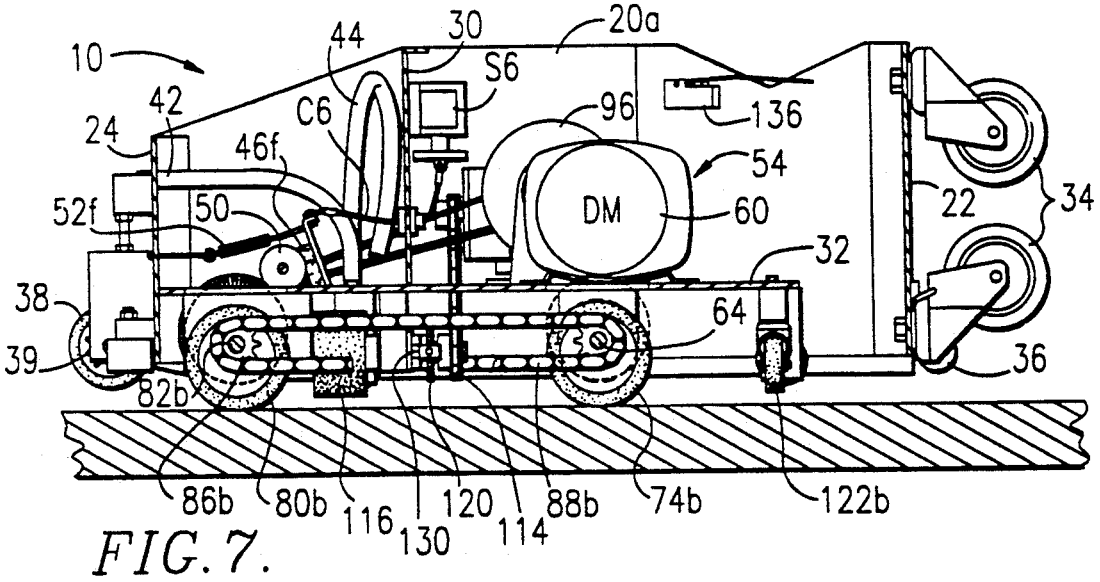
FIG. 7.
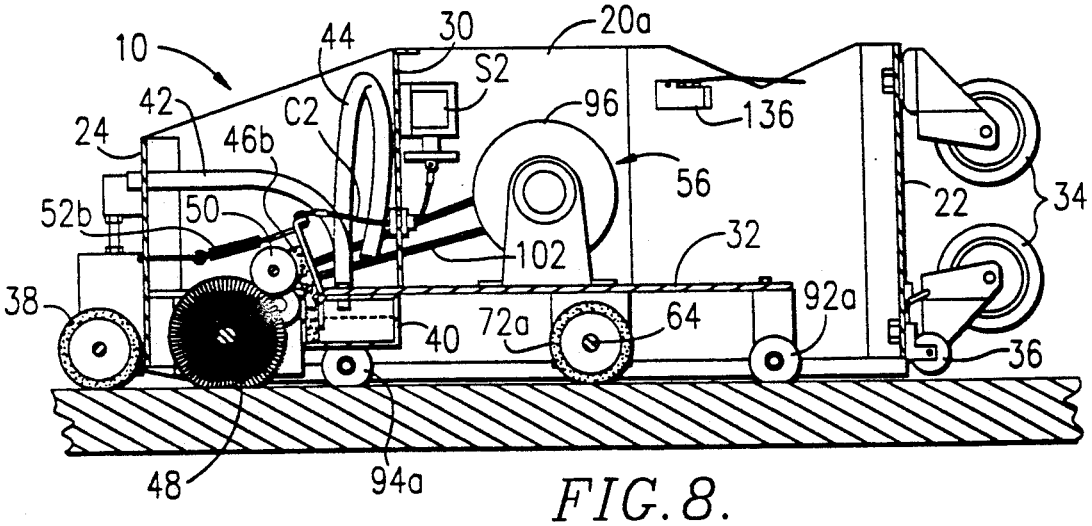
FIG. 8.
FIG. 9.
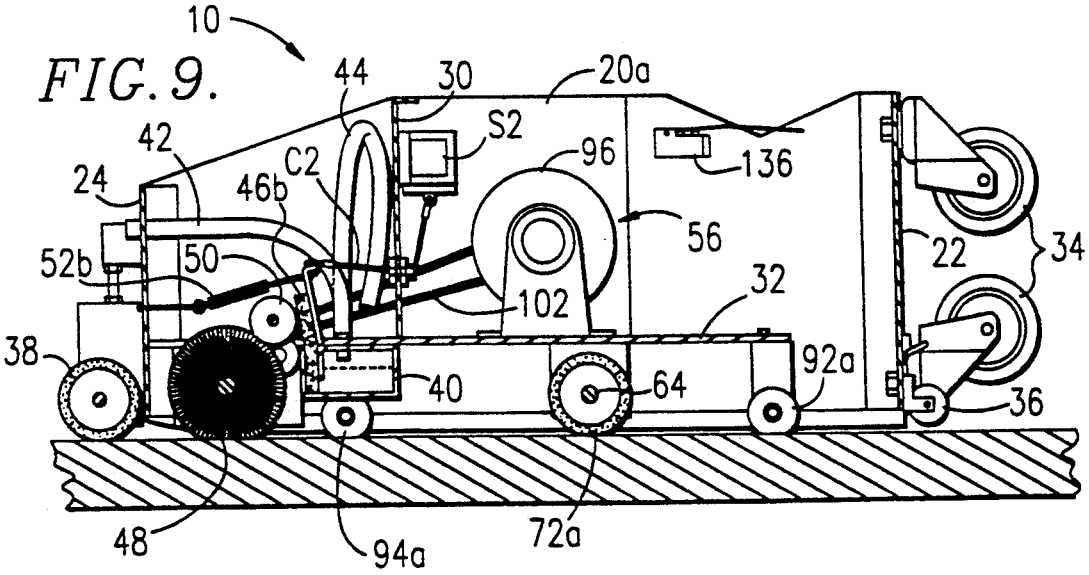

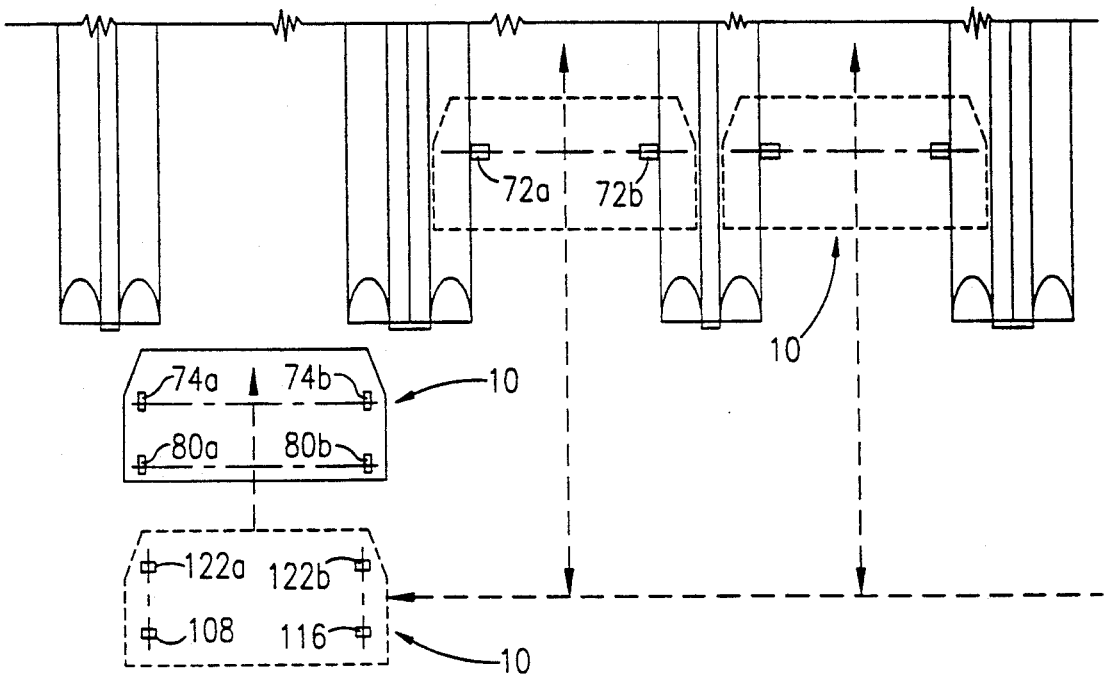
FIG. 12.
FIG. 13.
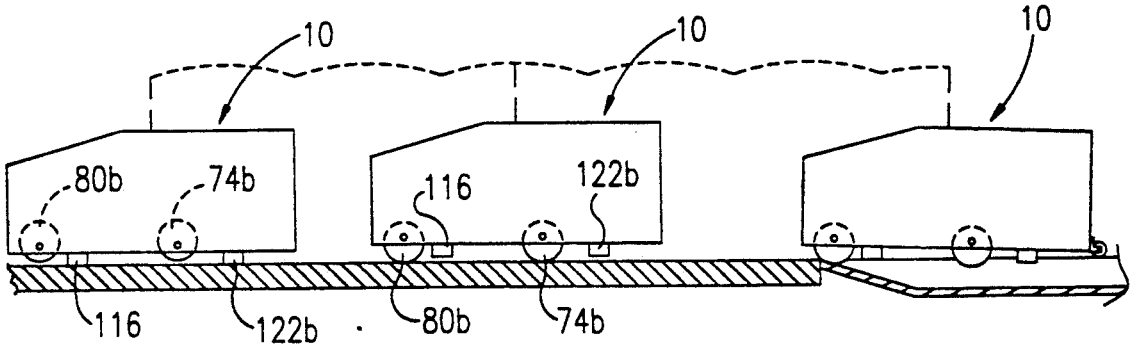

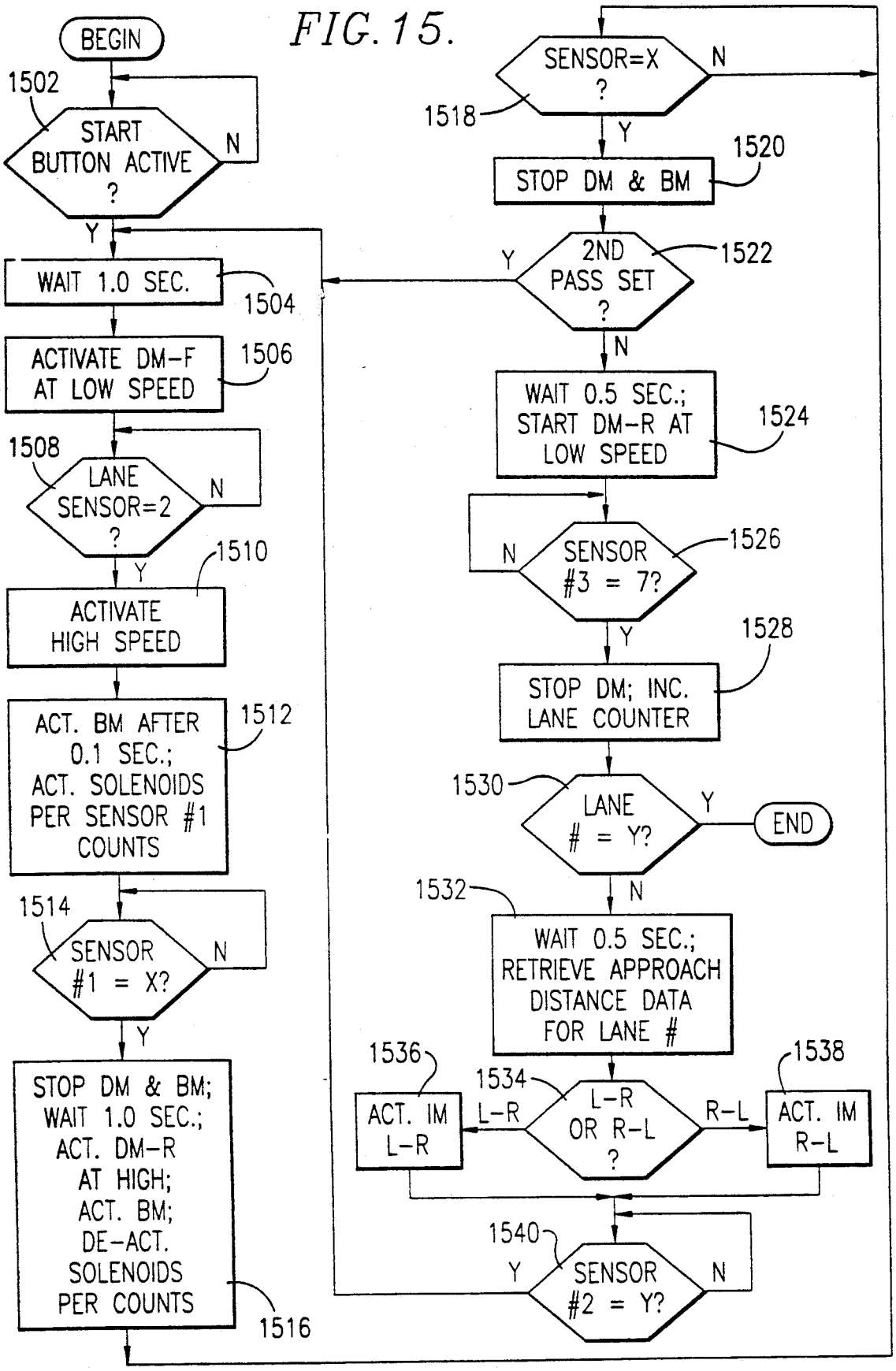
FIG. 15.
BEGIN
1502
START BUTTON ACTIVE ?
N
Y
WAIT 1.0 SEC.
1504
ACTIVATE DM-F AT LOW SPEED
1506
1508
LANE SENSOR=2 ?
N
Y
1510
ACTIVATE HIGH SPEED
ACT. BM AFTER 0.1 SEC.; ACT. SOLENOIDS PER SENSOR #1 COUNTS
1512
1514
SENSOR #1 = X?
N
Y
STOP DM & BM; WAIT 1.0 SEC.; ACT. DM-R AT HIGH; ACT. BM; DE-ACT. SOLENOIDS PER COUNTS
1516
SENSOR=X ?
1518
N
Y
STOP DM & BM
1520
2ND PASS SET ?
1522
Y
N
WAIT 0.5 SEC.; START DM-R AT LOW SPEED
1524
SENSOR #3 = 7?
1526
N
Y
STOP DM; INC. LANE COUNTER
1528
LANE # = Y?
1530
Y
END
N
WAIT 0.5 SEC.; RETRIEVE APPROACH DISTANCE DATA FOR LANE #
1532
L-R OR R-L ?
1534
L-R
R-L
ACT. IM L-R
1536
ACT. IM R-L
1538
SENSOR #2 = Y?
1540
Y
N

BOWLING LANE MAINTENANCE MACHINE CAPABLE OF SELF-INDEXING FROM LANE-TO-LANE

BACKGROUND OF THE INVENTION

1. Field of the Invention

The present invention relates to a bowling lane maintenance machine which performs selected maintenance operations on the surface of the bowling lane, shifts itself to the approach area spanning a plurality of lanes behind the foul line end of the lanes, indexes to another lane, and then shifts to this lane to again perform a maintenance operation thereon.

2. Description of the Prior Art

In the prior art, devices have been designed to perform maintenance on a bowling lane which automatically traverse the length of the bowling lane and then shift to another lane to perform a maintenance operation thereon. Such a prior art device is illustrated in U.S. Pat. No. 4,738,000 which uses a mechanism to detect a bowling lane end cap for guiding the machine from one lane to an adjacent lane. Air cylinders lift the machine so that the lane driving wheels no longer contact lane surface to allow the traversing wheels to shift the appartus across lane division caps to an adjacent lane.

The prior art devices present mechanically complex structures for movement and guidance. Accordingly, the prior art points out the need for a bowling lane maintenance machine which is mechanically simpler and thereby more reliable and easier to maintain.

SUMMARY OF THE INVENTION

The invention hereof solves the prior art problems discussed above and presents a distinct advance in the state of the art. More particularly, the preferred machine hereof is mechanically simpler than the prior art which leads to enhanced reliability, easier maintenance, and lower cost.

Broadly speaking, the preferred machine includes a lane maintenance assembly, a propulsion mechanism for selectively imparting longitudinal movement along a lane, lane-to-lane movement by way of the approach area spanning a plurality of lanes, and transition movement between a lane and the approach area, and a controller for controlling the maintenance assembly and propulsion mechanism.

In preferred forms, the propulsion mechanism includes eccentrically mounted transition wheels which walk the machine between a lane and the approach area. Indexing wheels provide lane-to-lane movement in the approach area and, during longitudinal lane movement, extend into the respective gutters on the sides of the lane in a non-supporting relationship. The preferred controller includes an indexing distance sensor for positioning the machine precisely in front of a selected lane to be maintained. Other preferred aspects of the present invention are disclosed herein.

BRIEF DESCRIPTION OF THE DRAWINGS

FIG. 7 is a sectional view taken along line 7—7 of FIG. 2;

FIG. 8 is a sectional view taken along line 8—8 of FIG. 2 illustrating the lane dressing wick in the engaged position;

FIG. 9 is another sectional view taken along line 8—8 of FIG. 2 illustrating the lane dressing wick in the disengaged position;

FIG. 12 is a schematic representation of the various movements of the machine relative to a plurality of bowling lanes and the approach area spanning the lanes beyond the foul line end;

FIG. 13 is a schematic representation illustrating the walking action of the machine when making the transition between the bowling lane and the approach area;

FIG. 15 is a computer program flow chart illustrating the operation of the controller of FIG. 14.

DETAILED DESCRIPTION OF THE PREFERRED EMBODIMENT

Figure 6:
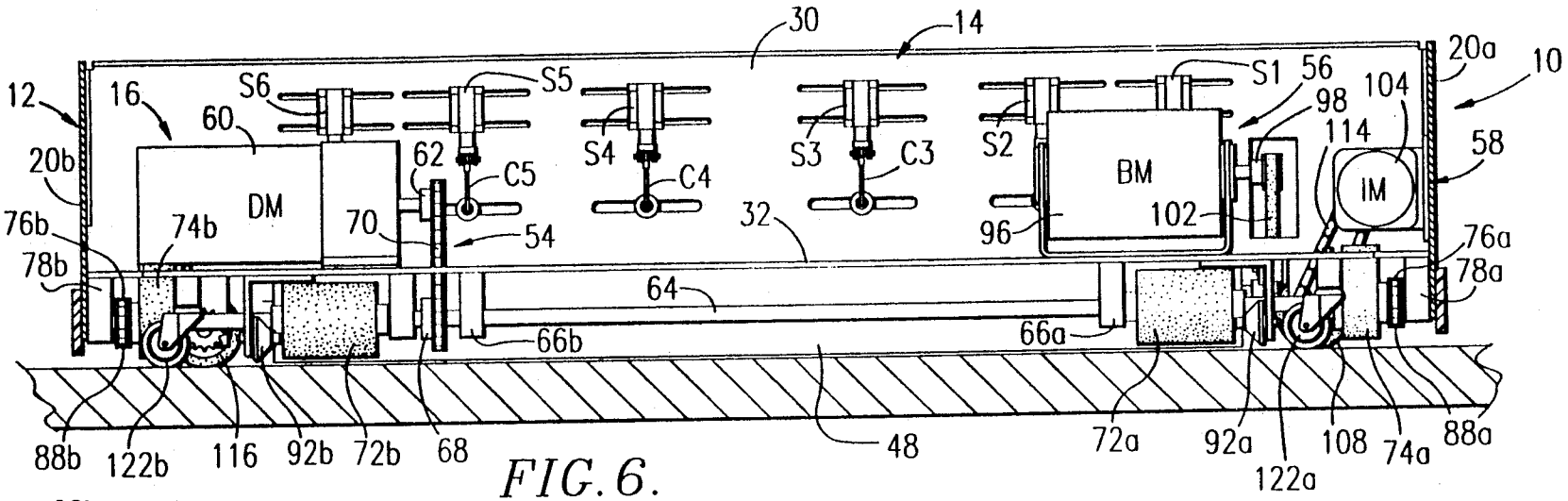
FIG. 6 is a sectional view taken along line 6—6 of FIG. 2.

The drawing figures illustrate preferred bowling lane maintenance machine 10 which broadly includes housing 12, maintenance assembly 14, propulsion assembly 16 and control system 18.

Figure 1:
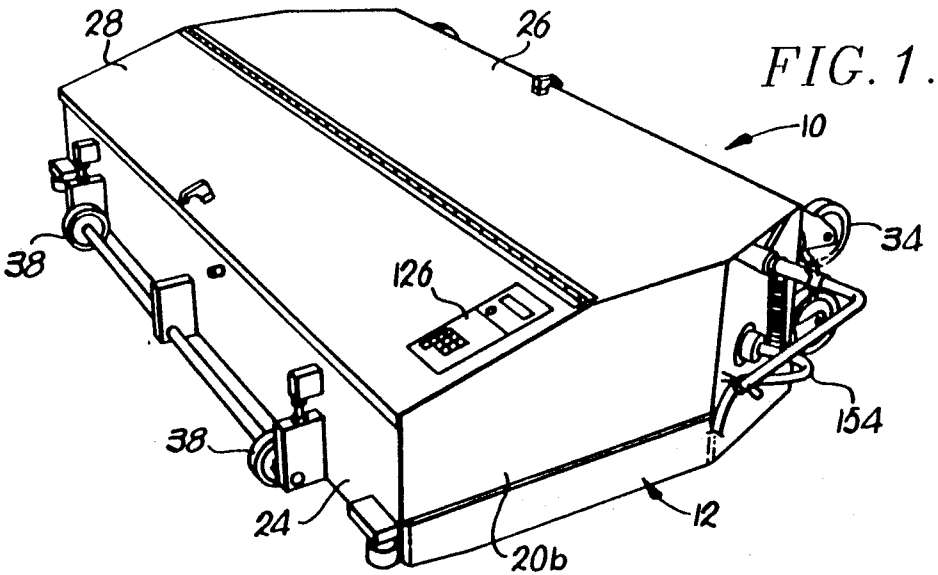
FIG. 1 is a perspective view of the preferred bowling lane maintenance machine showing the right and rear sides and the top.
Figure 2:
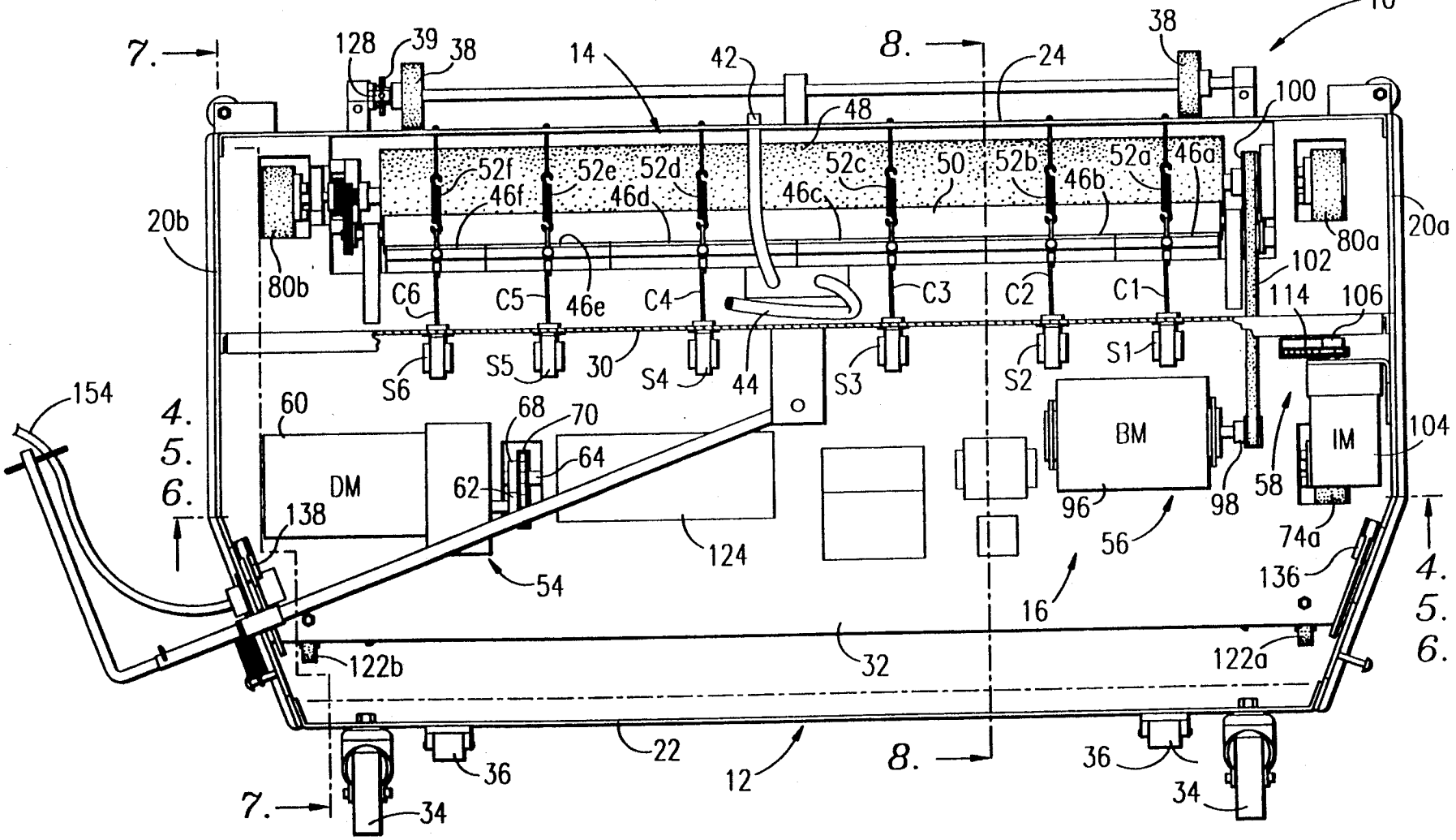
FIG. 2 is a plan view of the machine with the top covers removed to illustrate the upper components.
Figure 3:
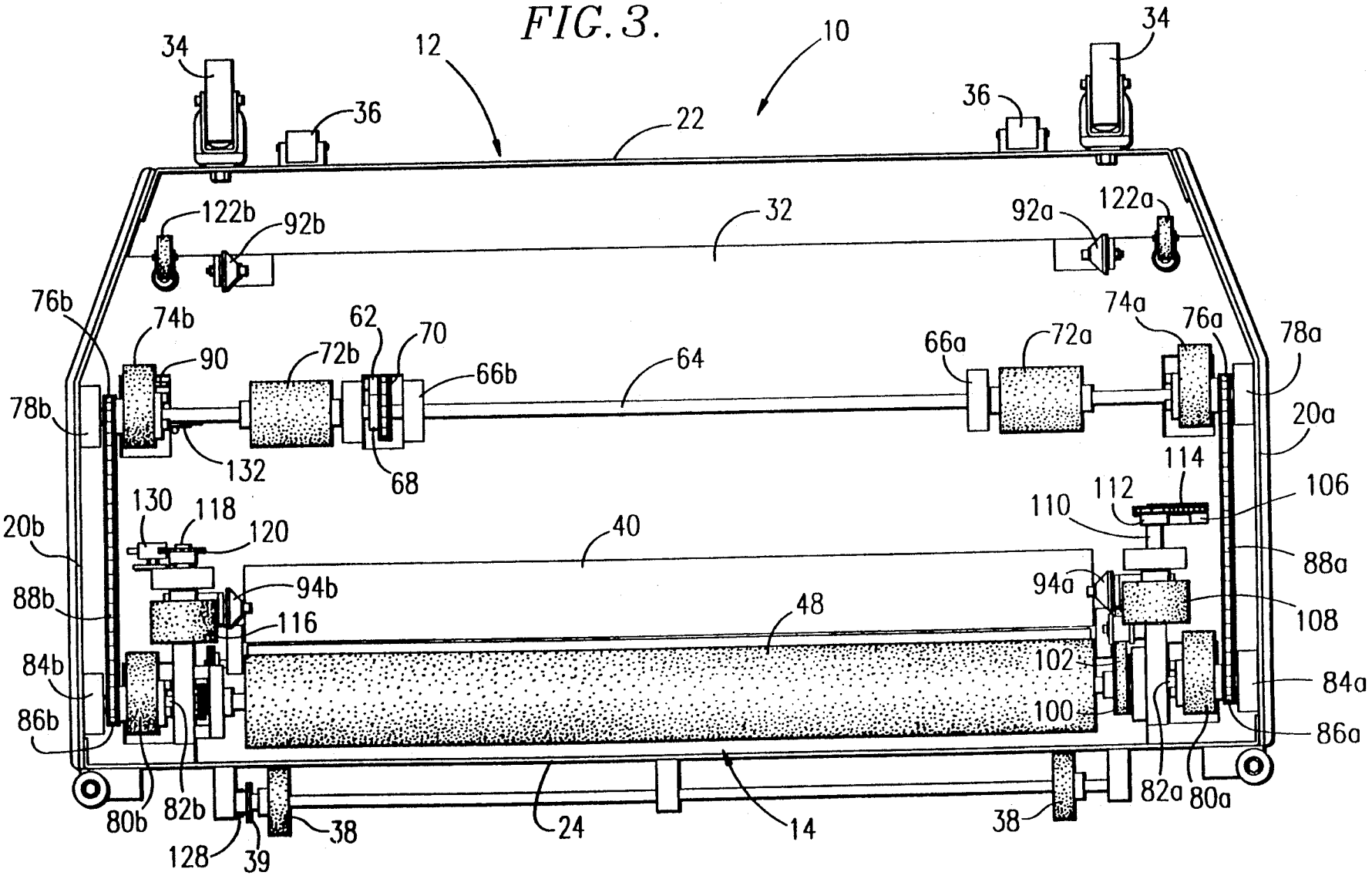
FIG. 3 is a bottom plan view of the machine components.

Housing 12, as illustrated in FIGS. 1, 2 and 3, includes left wall 20*a*, right wall 20*b*, front wall 22, rear wall 24, top front cover 26 hingedly coupled with top rear cover 28, interior, upright dividing wall 30, and interior horizontal support wall 32.

Front wall 22 carries four castor wheels 34 for rollably supporting machine 10 on end during storage and transfer. Assist rollers 36 are also connected to front wall 22 as shown most clearly in FIGS. 7–9 and assist during transition of machine 10 from the lane maintenance position to the indexing position on the approach area. Rear wall 24 carries a pair of lane support idler rollers 38 and lane distance indicating sprocket 39. Covers 26 and 28 can be removed for easy access of interior of housing 12 during maintenance and repair.

Maintenance assembly 14 provides the desired maintenance to the surface of a bowling lane which in the preferred embodiment is the application of lane dressing to about two-thirds of the lane. As those skilled in the art will appreciate, the desired lane maintenance may also include the application of a stripping solvent to remove old lane dressing in preparation for a new application, and general sweeping of the lane for removal of debris. Assembly 14 includes lane dressing reservoir 40 extending across the interior width of housing 12 rearwardly of dividing wall 30 and below horizontal wall 32, reservoir fill tube 42, reservoir overflow tube 44, shiftable wicks 46/a,b,c,d,e and f extending along the length of reservoir 40, buffer 48, lane dressing transfer roller 50 between wicks 46 and buffer 48, and solenoids S1,2,3,4,5 and 6 mounted to the forward side of dividing wall 30 as shown in FIGS. 2, 6 and 7. Cables C1,2,3,4,5 and 6 extend through dividing wall 30 and interconnect solenoids S1–6 and wicks 46/a–f. Springs 52a,b,c,d,e and f interconnect wicks 46/a–f and rear wall 24, and bias wicks 46/a–f in the engaged position as best shown in FIG. 7.

Propulsion assembly 16 includes lane drive sub-assembly 54, buffer drive sub-assembly 56, and indexing sub-assembly 58.

Lane drive sub-assembly 54 provides the propulsion of the machine 10 longitudinally along the bowling lane, and also provides the transition between the bowling lane and the approach area. Sub-assembly 54 includes drive motor 60 supported on horizontal wall 32 forward of dividing wall 30 having drive sprocket 62, drive shaft 64 suspended under horizontal wall 32 by bearings 66*a* and *b*, driven sprocket 68 interconnected with drive sprocket 62 by chain 70. Sub-assembly 54 further includes lane-width spaced, lane drive wheels 72*a* and *b* supported on shaft 64, eccentrically mounted transition wheels 74*a* and *b* also supported on shaft 64 respectively outboard of wheels 72*a,b*, and transition sprockets 76*a* and *b* also supported on shaft 64 outboard of transition wheels 74*a,b*. Bearings 78*a,b* are mounted respectively wall 32 adjacent to the interior surfaces of walls 20*a,b* and support the respective ends of shaft 64.

Figure 11:
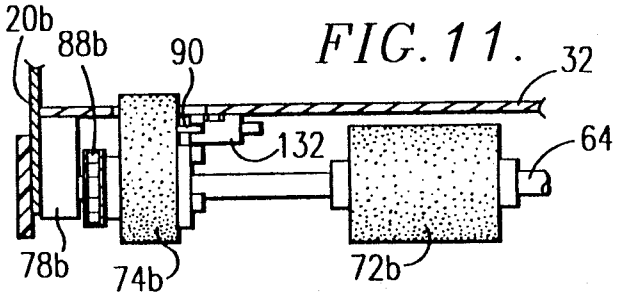
FIG. 11 is a partial sectional view illustrating the transition wheel position sensor.

Another set of eccentrically mounted transition wheels 80*a* and *b* and mounted adjacent rear wall 24 by stub shafts 82*a* and *b* and mounting bearings 84*a* and *b* mounted to wall 32 adjacent the interiors of left and right walls 20*a,b*. Sprockets 86*a* and *b* are respectively mounted to stub shafts 82*a* and *b* and are interconnected with transition sprockets 76*a,b* by transition chains 88*a,b*. Transition wheel 74*b* includes metal projection 90 as shown in FIGS. 3 and 11 which is used to indicate the position of wheels 74*a,b* and 80*a,b* as explained further hereinbelow.

Figure 4:
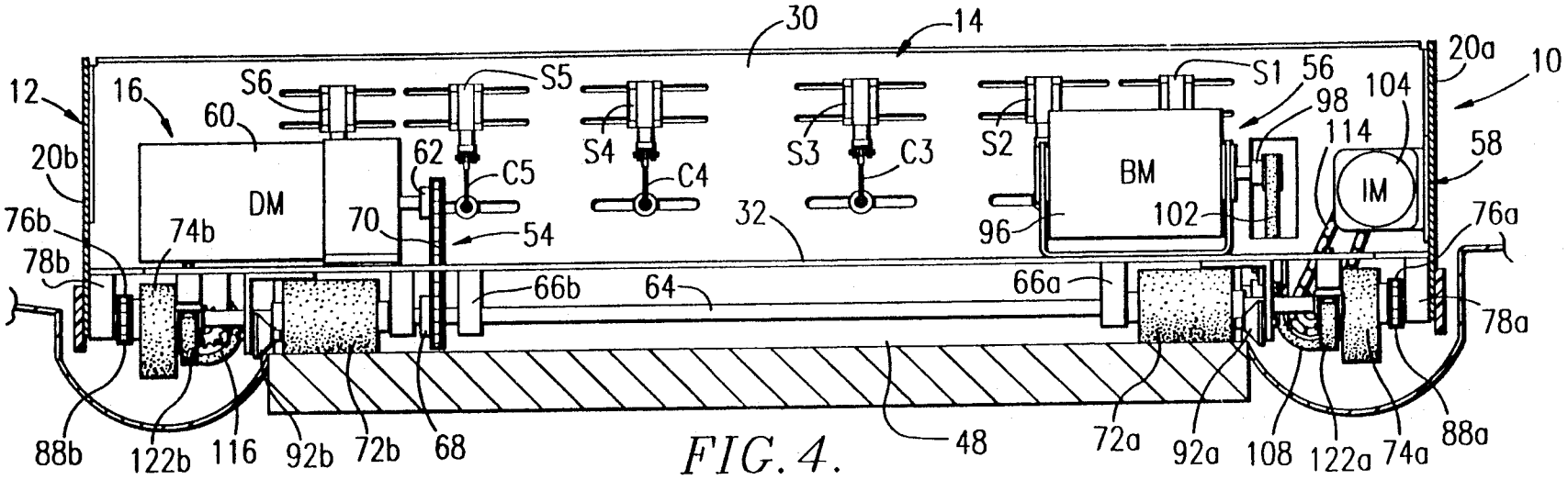
FIG. 4 is a sectional view taken along line 4—4 of FIG. 2.
Figure 5:
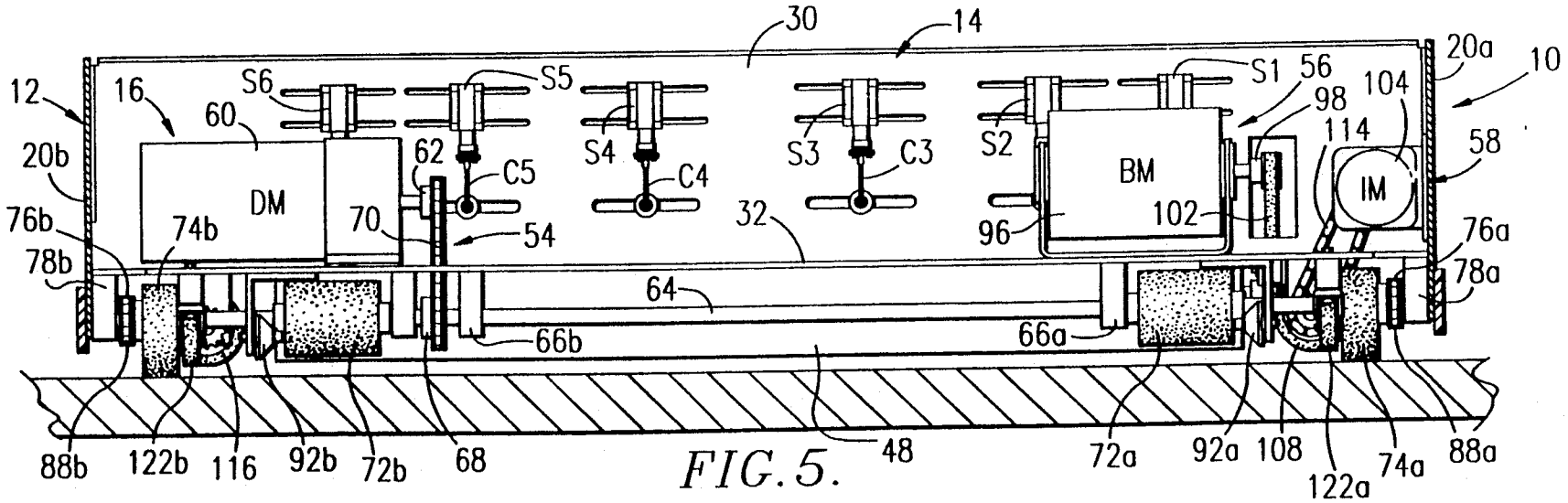
FIG. 5 is a sectional view taken along line 5—5 of FIG. 2.

Transition wheels 74*a,b* and 80*a,b* are spaced apart a distance sufficient to span the width of a lane and thereby extend into the adjacent lane gutters as illustrated in FIG. 4 whenever machine 10 is in a lane maintenance position. In this position, machine 10 is supported on lane support rollers 38 and lane drive wheels 72*a,b* and thus, the transition rollers are in a non-supporting relationship with machine 10.

As mentioned above, transition wheels 74*a,b* and 80*a,b* are eccentrically mounted on their respective shafts to present a camming action as they rotate. As explained further hereinbelow, this results in a walking action as machine 10 makes the transition between a lane maintenance position and an adjacent approach area.

Lane drive sub-assembly 54 also includes frustoconically shaped lane guide rollers 92*a* and *b* and 94*a* and *b* mounted as best viewed in FIG. 3 and spaced slightly greater than the width of the bowling lane. As can be appreciated, rollers 92*a,b* and 94*a,b* ensure that machine 10 stays centered as it moves longitudinally along a bowling lane.

Buffer drive sub-assembly 56 provides the power to drive buffer 48 and transfer roller 50. Sub-assembly 56 includes buffer motor 96 (FIGS. 2 and 4–6) having output drive sheave 98, driven sheave 100 mounted to the shaft of buffer 48, and V-belt 102 interconnecting sheaves 98 and 100.

Indexing sub-assembly 58 provides lane-to-lane movement of machine 10 in the lane approach area. Sub-assembly 58 includes indexing motor 104 having output drive sprocket 106 (FIGS. 3–6), indexing drive wheel 108 mounted to shaft 110 along with indexing driven sprocket 112 mounted to the end thereof. Indexing chain 114 interconnects drive sprocket 106 and driven sprocket 112. Sub-assembly 58 also includes indexing idler wheel 116 mounted to stub shaft 118 with distance counting sprocket 120 mounted to the end thereof as best viewed in FIG. 3. This sprocket provides indexing distance measurement as explained further herein below in connection with the control system 18. Indexing wheels 108 and 116 provide support to machine 10 near the rearward portion thereof. Indexing swivel castor wheels 122*a* and *b* provide rolling support near the forward portion of machine 10.

As will be appreciated, indexing wheels 108, 116 and 122*a,b* are mounted transversely to the lane drive wheels and transition wheels in order to shift machine 10 transversely in the bowling lane approach area for lane-to-lane movement. Indexing wheels 108, 116 and 122*a,b* also extend into respective lane gutters when machine 10 is lane maintenance position as illustrated in FIG. 4. Thus, in this position, these indexing wheels are in a non-supporting relationship with machine 10.

Figure 14:
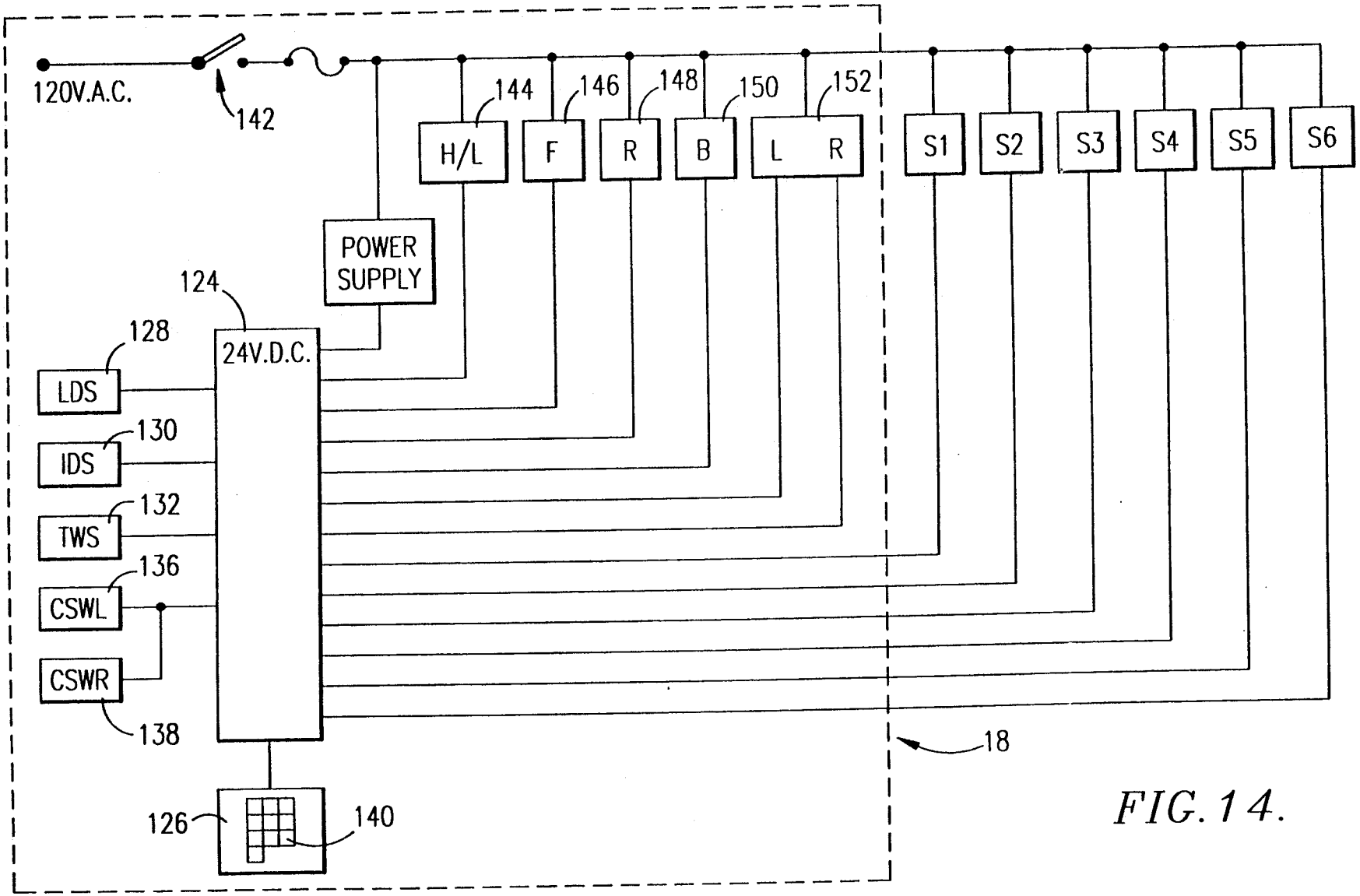
FIG. 14 is an electrical schematic diagram of the electrical components of the machine.

Control system 18 operates on conventional 120 VAC power and includes controller 124 (OMRON SYSMAC programmable controller model C28H), data entry keypad 126, lane distance sensor 128 (LDS), indexing distance sensor 130 (IDS), transition wheel position sensor 132 (TWS), left cord switch 136 (CSWL), right cord switch 138 (CSWR), start switch 140, power switch 142, high/low speed drive motor relay 144, forward drive motor relay 146, reverse drive motor relay 148, buffer motor relay 150, and left/right indexing motor relay 152, interconnected as illustrated in FIG. 14. Additionally, FIG. 14 illustrates the connections between controller 124 and solenoids S1–6.

In general, controller 124 operates according to computer program flow chart illustrated in FIG. 15 and discussed further herein below. Sensors and switches 128–138 along with keypad 126 provide inputs to controller 124 and the outputs therefrom are provided to relays 142–152 and solenoids S1–6. Conventional data entry keypad 126 allows an operator of machine 10 to enter starting and stopping lanes for a maintenance operation and allows changes in data entered when machine 10 was initialized.

Figure 10:
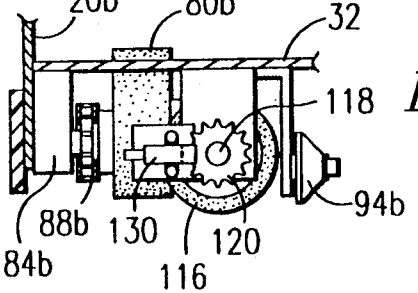
FIG. 10 is a partial sectional view illustrating the indexing distance sensor.

Lane distance sensor 128 (SUNX PMT53), illustrated in FIG. 2, is an infrared sensor connected to rear wall 24 adjacent indicator sprocket 39. As machine 10 moves longitudinally, lane support rollers 38 rotate as does indicating sprocket 39. As each tooth of sprocket 39 interrupts the infrared beam, sensor 128 provides an input count to controller 124. These counts are used to determine the longitudinal travel of machine 10 along the bowling lane. Indexing distance sensor 130 is also an infrared pulse counter (SUNX PMT53), and most clearly shown in FIG. 10. Indexing distance sprocket 120 is mounted on the same shaft as indexing idler wheel 116 and rotates therewith, and in so doing, the teeth of sprocket 120 interrupt the infrared beam from indexing distance sensor 130. As machine 10 moves sidewise in the bowling lane approach area, the count pulses provided by sensor 130 to controller 124 provide a measurement of the distance traveled.

Transition wheel position sensor 132 is also an infrared sensor. The infrared beam of this sensor is interrupted by projection 90 attached when transition wheel 74*b* is in its rotated up position. With all four transition wheels interlocked, sensor 132 can inform controller 124 when all of the transition are in the up position which means that machine 10 is supported by the indexing wheels in the approach area, or by the lane wheels when on a lane.

Cord switches 136 and 138 (FIG. 2) also function to stop operation of machine 10 if power cord 154 is strained during lane movement. In other words, if power cord 154 were to become strained, machine 10 is stopped before cord 154 is torn loose.

Relays 144, 146, and 148 include contacts conventionally wired to drive motor 60 to control the speed and the direction thereof. Buffer relay 150 is conventionally connected to start and stop buffer motor 96, and indexing relay 152 controls the direction of rotation of indexing motor 104 in order to shift machine 10 left or right during lane to lane movement in the approach area.

Controller 124 also activates solenoids S1–6 at programmed distances of travel along the bowling lane, these distances being indicated by lane distance sensor 128. In this way, the amount of lane dressing applied to the lane is controlled in each area of a lane served by a corresponding wick 45*a–f* to provide the exact, desired profile.

OPERATION

Machine 10 and specifically controller 124 are initialized in data and memory representative of the number of bowling lanes in a customer's bowling center, the center line spacing between lanes, the approach area distance available behind the foul line end of each lane, and the length of the bowling lane to be treated or maintained. As mentioned above, machine 10 can be stored on end supported by castor wheels 34 and in this way can be stored in a very compact space. Before use and while still in the upright position, the operator would normally ensure that reservoir 40 is full to the proper level by filling it through fill tube 42 with overflow tube 44 placed in a catch bucket to collect any excess. This prevents over filling which has been a problem in the prior art.

To use, the operator wheels machine 10 out of storage and then tilts it into the lane maintenance position on the first lane to be maintained. After plugging in power cord 154 and turning on power switch 142, the operator then enters, by way of keypad 126, the lane numbers to be maintained starting with the lane on which machine 10 is resting. In other words, lane maintenance need not begin with lane 1, but rather may begin with any lane of choice. By virtue of the lane numbers entered, controller 124 can determine whether indexing needs to take place left to right or right to left.

Referring now to FIG. 15, activation of start switch 140 by the operator is determined at step 1502. When the start switch is active, the answer in this step is yes and the program moves to step 1504 which provides a 1.0 second wait time.

In step 1506, drive motor 60 is energized when high/low speed relay 144 is activated for low speed and forward relay 146 is activated for the forward direction. Machine 10 then begins to travel from the foul line end toward the pin end of the lane which is the forward direction at low speed.

Lane distance sensor 128 continually feeds lane distance travel counts to controller 124 while traveling on a lane. Step 1508 asks whether the sensor indicates a count of 2 and loops through this step until the answer is yes after which step 1510 then activates relay 144 for high speed. This tells controller 124 that machine 10 is properly centered and traveling on a lane up for a distance of about 2 inches at low speed before shifting to high speed.

After a delay of 0.1 seconds, step 1512 then activates buffer relay 150 which energizes buffer motor 96 to begin operation. When solenoids S1–S2 and de-energized, wicks 46*a–f* are in contact with transfer roller 50 under the bias of springs 52*a–f*. In this engaged position, lane dressing migrates upwardly from reservoir 40 through wicks 46*a–f* onto transfer roller 50 and then to buffer 48 which then applies the lane dressing to the surface of the bowling lane.

Depending upon the desired profile of lane dressing application, data is entered into controller 124 to activate and deactivate solenoids S1–6 at selected distances of travel along the lane as indicated by sensor 128. In other words, from time to time depending on the count data entered into controller 124 during initialization, various solenoids S1–6 are energized to shift their respect wicks 46*a–f* to the disengaged positions as illustrated in FIG. 9. This flexibility in operation allows each bowling facility to be provided with its own distinctive lane dressing profile if desired. Additionally, controller 124 includes a real time, date and time clock which allows data to be retrieved according to the date and time of day. This is particularly advantageous because different applications of lane dressing may be required in the morning versus the afternoon. For example, a bowling facility operator may wish to apply a relatively light application of lane dressing in the morning during low periods of bowling activity during the day, and a higher application of lane dressing in late afternoon in preparation for active league play in the evening. Additionally, the facility operator may desire different profiles depending upon the day of the week.

When machine 10 has traveled forwardly along the lane the desired distance represented by "X" (typically 24–40 feet as determined by sensor 128) in step 1514, the answer in this step is yes and the program moves to step 1516. This step de-energizes drive motor 60 and buffer motor 96 by way of relays 144–150 and machine 10 stops. The program then provides a delay of 1.0 seconds after which relay 148 is activated for the reverse direction of drive motor 60. Machine 10 then begins to travel back toward the foul line while continuing to activate solenoids S1–6 according to predefined counts as determined by lane distance sensor 128.

When machine 10 has completed its travel back to the point of origin on the lane, typically the foul line, the answer in step 1518 is yes. Step 1520 then de-energizes drive motor 60 and buffer motor 96.

Step 1522 then asks whether the operator has indicated that machine 10 should make a second maintenance pass on the lane. This might be desirable, for example, if the lane has been completely stripped of dressing and two passes may be required for proper maintenance. If the answer in step 1520 is yes, the program moves back through steps 1504–1520.

After completion of the second pass, or if the answer in step 1522 is no, the program moves to step 1524. Here the program waits for 0.5 seconds and then activates relay 144 at low speed and relay 148 for the reverse direction of drive motor 60. As will be appreciated in the discussion in connection with lane drive sub-assembly 54, lane drive wheels 72*a,b* and transition wheels 74a,b and 80a,b are all powered by drive motor 60. This provides the advantage of requiring only one motor for lane propulsion and transition. As will be appreciated from this arrangement, transition 74a,b and 80a,b also rotate as machine 10 moves longitudinally along the lane, but these wheels extend into the gutters along either side of the lane and so this motion of the transition wheels does not affect machine 10 during this movement.

At the end of a maintenance pass, however, when drive motor 60 is again energized in reverse, machine 10 approaches the foul line end of the gutters and intially transition wheels 74a,b engage the edge of of the approach area adjacent the foul line and the end of the gutter as illustrated in FIG. 12. This action lifts and pulls machine 10 onto the approach area in a "walking" action. As machine 10 moves further into the approach area, transition wheels 80a,b eventually also reach the end of the gutters and also engage the surface of the approach area, and in this way machine 10 makes the transition from the lane maintenance position to the approach area. As illustrated in FIG. 12, this walking action continues until machine 10 has traveled a sufficient distance away from the foul line and into the approach area. This distance is determined by counting the number of counts provided by transition wheel position sensor 132.

With each pass of projection 90 across the beam of sensor 132, a count is provided to controller 124. When seven counts have been detected, the answer in step 1526 is yes and the program moves to step 1528. In this step, drive motor 60 is de-energized by way of relays 144 and 148.

It will be appreciated that the count of seven is achieved when projection 90 makes its seventh break of the beam emitted by sensor 132. Drive motor 60 stops immediately which leaves transition wheels 74a,b and 80a,b in their up position. This means that machine 10 is now resting on indexing wheels 108, 116, and 122a,b, recalling that these wheels project downwardly below the level of various lane support wheels. Thus, it is not necessary to provide hydraulic cylinders or other mechanisms for disengaging the lane support wheels.

Step 1528 also increments the lane counter and step 1530 then asks whether the current lane number is equal to the last lane number entered by the operator. If yes, the program ends, indicating that all of the desired lanes have been maintained.

If the answer is step 1530 is no, the program moves to step 1532 in which the program waits 0.5 seconds and then retrieves the approach distance data between the current lane and the next lane. In other words, the program retrieves the lane-to-lane distance to the next lane to be maintained. This data is part of the initialization of controller 124 for the particular customer.

The program then moves to step 1534 which asks whether the lane-to-lane movement is to be left to right or right to left. This is determined by whether the next lane bears a higher or lower lane number than the current lane. If the indexing movement is to be left to right the program moves to step 1536 which energizes relay 152 which in turn energizes indexing motor 104 for leftward movement as facing toward the pin end of the lanes. If the indexing movement is to be right to left, step 1538 activates relay 152 for right to left operation of indexing motor 104. After steps 1536 or 1538, the program moves to step 1540 which asks whether indexing distance sensor 130 has reached a count "Y" representative of the center line distances between the current lane and the next lane.

As those skilled in the art will appreciate, the center line distances between bowling lanes varies among bowling facilities. This variation usually occurs because of variations in the ridge widths between the lanes. Even in a given bowling facility, some slight variations in center line distances between lanes occurs. The initialization data stored in memory includes the precise distances between the specific lanes. It should also be appreciated that it is not required that machine 10 index to the next adjacent lane. For example, the operator could enter data for lanes 1,3,4 and 6 to be treated.

With machine 10 now indexed in front of the next lane, as indicated by a yes answer in step 1540, relay 152 is de-energized which in turn de-energizes indexing motor 104. The program then returns to step 1504 to continue the process for the next lane. More particularly, controller 124 again energizes drive motor 60 in forward low speed position which causes machine 10 to "walk" toward the indexed lane until it makes the transition from the approach area to a lane maintenance position in an action reverse of that described above.

As an inspection of the various drawing figures indicates, with particular reference to FIGS. 1 and 2, left and right walls 20a,b at their forward ends present inwardly extending surfaces which act as bumpers as machine 10 approaches a lane. In other words, even if machine 10 is off center slightly, these bumper surfaces engage the ridges extending upwardly between lanes which center machine 10 on the lane.

As those skilled in the art will appreciate from the discussion above, complete and unattended maintenance of all of the bowling lanes in a bowling center can be accomplished with the use of machine 10. After being provided with initial input data, machine 10 automatically proceeds to each designated lane, provides the required maintenance operation, and then proceeds to each designated lane automatically and without need for human intervention until all of the designated lanes have been treated, whereupon machine 10 stops. This capability enables the staff of a bowling facility to provide excellent maintenance with minimal labor and with minimal technical training.

Having thus described the preferred embodiment of the present invention, the following is claimed as new and is desired to be secured by Letters Patent:

1. A bowling lane maintenance machine for performing a maintenance operation on the surfaces of a plurality of generally parallel, elongated bowling lanes, each lane having opposed sides defined by respective lane gutters and having a foul line end, and with an approach area spanning the lanes beyond the foul line ends, said machine comprising:

a selectively activatable, lane maintenance assembly including means for selectively performing a maintenance operation on the bowling lane surfaces;

propulsion means coupled with said assembly for imparting selective movements thereto including longitudinal movement along a lane, lane-to-lane movement in the approach area spanning the lanes, and transition movement between a lane and the approach area; and control means coupled with said propulsion means for controlling said movements and coupled with said assembly for selective activation thereof in order to move said machine among a plurality of lanes for performing said maintenance operation thereon, said propulsion means including at least a pair of indexing rollers configured for rollably supporting said machine during said lane-to-lane movement, said rollers being spaced apart and configured for extending into respective lane gutters in a non-supporting relationship with said machine during said longitudinal movement.

2. The machine as set forth in claim 1, said maintenance assembly including means for applying lane dressing to the surface of the bowling lane as said maintenance operation.

3. The machine as set forth in claim 2, said applying means including a reservoir for storing lane dressing, rotatable buffer means for contacting the surface of the bowling lane for applying lane dressing thereto, and transfer means for transferring lane dressing from said reservoir to said buffer means.

4. The machine as set forth in claim 3, said transfer means including wick means extending from said reservoir for migration of lane dressing therefrom and a transfer roller positioned for contact for both said buffer means and said wick means for receiving migrated lane dressing from said wick means and for transferring said received lane dressing to said buffer means.

5. The machine as set forth in claim 4, said wick means including a plurality of wicks each having one end positioned within said reservoir and an opposed end selectively shiftable between an engaged position with said transfer roller and a disengaged position, said transfer means further including means for individually and selectively shifting said wicks between said engaged and disengaged positions, said control means including means coupled with said shifting means for selective control thereof.

6. The machine as set forth in claim 5, said control means further including means for measuring the distance of travel during said longitudinal movement and for controlling said shifting means in predetermined relationship with the distance of travel.

7. The machine as set forth in claim 1, said propulsion means including a plurality of lane rollers operably coupled with a reversible lane motor, said control means including means for controlling the operation and direction of rotation of said lane motor for controlling said longitudinal movement.

8. The machine as set forth in claim 7, said control means including means for measuring the distance of travel during said longitudinal movement and for controlling the operation and direction of rotation of said lane motor in accordance with distance of travel.

9. The machine as set forth in claim 7, said propulsion means including transition means for performing said transition movement, said transition means including a plurality of eccentrically mounted, rotatable transition wheels presenting synchronized up and down positions during rotation thereof in order to raise and lower said machine during said transition movement thereby presenting a walking motion.

10. The machine as set forth in claim 9, said transition wheels being spaced apart and configured for extending into respective lane gutters in a non-supporting relationship with said machine during said longitudinal movement.

11. The machine as set forth in claim 9, said transition wheels being operably coupled with said lane motor for powered rotation thereby.

12. The machine as set forth in claim 1, said control means including means for measuring the distance of travel during said lane-to-lane movement and for storing lane spacing data representative of the spacing between successive lanes on which said maintenance operation is to be performed, said control means further including means for controlling said lane-to-lane movement in accordance with said lane spacing data in order to index said machine from one lane to another.

13. The machine as set forth in claim 12, further including angled bumper means for engaging the divider ridge between lanes for ensuring centering of said machine on a lane during said transition movement from the approach area to the lane.

14. The machine as set forth in claim 1, further including housing having an end wall with a plurality of storage support wheels coupled thereto for rollably supporting said machine on end in a storage position.

15. The machine as set forth in claim 14, said maintenance assembly including means for applying lane dressing to a lane, said applying means including a reservoir for storing lane dressing, structure defining a reservoir fill opening and a reservoir overflow outlet positioned for preventing the filling of said reservoir with lane dressing above a predefined level in said storage position.

16. The machine as set forth in claim 1, said maintenance assembly including means for applying lane dressing to a lane, said applying means including a reservoir for storing lane dressing, structure defining a reservoir fill opening and a reservoir overflow outlet positioned for preventing the filling of said reservoir with lane dressing above a predefined level.

17. The machine as set forth in claim 1, said control means including means for receiving lane number data representative of the lanes on which said maintenance operation is to be performed, said lane-to-lane movement including selectable left and right movements in the approach area, said control means including means for selecting one of said left and right movements in accordance with the next lane on which said operation is to be performed as represented by said lane number data.

18. The machine as set forth in claim 1, said control means including a programmable controller.

* * * * *